US005178561A

United States Patent [19]

Lindeberg et al.

[11] Patent Number: 5,178,561

[45] Date of Patent: Jan. 12, 1993

[54] INSULATING PLUG FOR USE IN ELECTRIC CONNECTORS

[75] Inventors: Sven E. Lindeberg, Houilles; Claude Casses, Clevilliers, both of France

[73] Assignee: Thomas & Betts Corporation, Bridgewater, N.J.

[21] Appl. No.: 752,718

[22] Filed: Aug. 30, 1991

[30] Foreign Application Priority Data

Sep. 14, 1990 [FR] France ..... 90 11411

[51] Int. Cl.[5] ..... H01R 13/645

[52] U.S. Cl. ..... 439/571; 439/681

[58] Field of Search ..... 439/571, 677, 680, 681, 439/171, 174

[56] References Cited

U.S. PATENT DOCUMENTS

| | | | |
|---|---|---|---|
| 3,177,461 | 4/1965 | Hagan et al. | 339/184 |
| 3,325,771 | 6/1967 | Ruehlemann et al. | 339/184 |
| 3,582,867 | 6/1971 | Thompson et al. | 339/92 |
| 3,611,272 | 10/1971 | Fairbairn et al. | 339/184 |
| 3,714,617 | 1/1973 | Bright et al. | 339/186 |
| 4,159,862 | 7/1979 | Funck et al. | 339/186 |
| 4,277,126 | 7/1981 | Lincoln | 339/186 |
| 4,478,469 | 10/1984 | Waite et al. | 339/17 |
| 4,568,134 | 2/1986 | DiMondi | 339/17 |
| 4,662,705 | 5/1987 | Prechtl et al. | 339/184 |
| 4,778,411 | 10/1988 | Rudy, Jr. et al. | 439/681 |
| 4,790,763 | 12/1988 | Weber et al. | 439/65 |
| 4,822,305 | 11/1989 | Waters | 439/681 |

FOREIGN PATENT DOCUMENTS

| | | | |
|---|---|---|---|
| 7509792 | 7/1975 | Fed. Rep. of Germany . | |
| 2455409 | 8/1976 | Fed. Rep. of Germany . | |
| 2191302 | 2/1974 | France . | |
| 1441656 | 7/1976 | United Kingdom | 439/680 |
| 2193051 | 1/1988 | United Kingdom . | |

*Primary Examiner*—Eugene F. Desmond

*Attorney, Agent, or Firm*—Robert M. Rodrick; Salvatore J. Abbruzzese

[57]. ABSTRACT

A connector comprises a plug of electrically insulating material and a housing box for accommodating electric contacts therein. The plug is selectively insertable in the box and comprises at least one first element insertable in a bore of the box formed for accommodating the contacts, and a second element for insertion in a corresponding opening of a printed circuit board. The plug selectively includes a bore for receipt of a complementary electric contact or a lug closing the box bore for preventing receipt of a complementary electric contact.

11 Claims, 3 Drawing Sheets

INSULATING PLUG FOR USE IN ELECTRIC CONNECTORS

FIELD OF THE INVENTION

This invention deals with a plug of electrically insulating material, of the type adapted to be inserted in a connector box for accommodating electric contacts. The invention is particularly concerned with a connector including such a plug for insertion into a box accommodating electric contacts intended for connection to a printed circuit board.

BACKGROUND OF THE INVENTION

Plugs of electrically insulating material are already known in the prior art. For example, patents already disclose electric connectors having particular shapes of position coding means to allow a selective positioning relative to a reception device. In a similar way, the prior art discloses the use of multiple coding keys which may be assembled and placed in various positions in order to realize several combinations of unique codes between the recesses of the connectors and the connecting elements. However, the above-mentioned documents mostly disclose coding keys designed to be typically used outside the openings of the box housing the connectors, which is provided for supporting electric contacts.

In particular, the DE-A-2,455,409 and U.S. Pat. No. A-4,478,469 appear to show the use of locking or coding elements conceived to be disposed in the same slots or openings of the connector box, which are used for receiving the electric contacts. However, neither of these two documents, nor any of the above-mentioned prior art, discloses the use of an insulating plug which, not only is insertable inside the same openings or recesses as those intended to receive the connecting electrical contacts, but also has two resilient areas, i.e., one having a connecting function in one opening of the connector box and the other to be inserted in an opening of the printed circuit board.

SUMMARY OF THE INVENTION

An object of the present invention is to provide a plug of electrically insulating material, of the above-mentioned type, the plug having at least two resilient areas which constitute at least a first element connectable in a bore of the connecting box for receiving the contacts and a second element intended to be inserted in a corresponding recess or opening of a printed circuit board which is to be connected with the box in order to achieve electrical connection between the electric contacts supported in the connector box and the printed circuit board.

According to a first advantageous feature of the invention, the first and second above-mentioned elements of the plug constitute part of the plug.

According to a preferred embodiment of the invention, the first element constitutes the essential part or elongate body of the plug and has a substantially rectangular transverse section, in the shape of a hook or a U which determines or defines an axial bore of the plug. The second element constitutes an extension of said body as a prolonged extremity thereof. At the free extremity of the body of the plug opposed to the second element, an axial bore opens at its outside or, according to an alternative modification, the axial bore is closed and is extended by a pin or nip having the shape adapted to close a corresponding bore of the connector box.

According to another embodiment of the invention, the plug is a double plug which includes two first elements connected with single second element, the two first elements being intended to be inserted in a connector box adapted to receive two rows of contacts. The two connecting elements extend substantially in parallel with the U-sections disposed in opposite directions.

According to still another aspect of the invention, the second element has the shape of a horseshoe defining an axial bore which:

- in the case of a plug with a single first element, extends in alignment with the axial bore of the single first element;
- in case of a double plug with two first elements, extends between the axial bores of the two first elements in the extension thereof, two arms of the second element, in the shape of a horseshoe defining two rest surfaces for two first elements, the axial bores of which end, partially, in opposite directions on each side of the rest surfaces.

According yet to still another aspect of the invention, a first element has, on one of its external surfaces, a locking member adapted to be connected in a corresponding transverse bore of the connector box.

The plug of the invention is thus intended to provide three functions, i.e. a centering function for the electric connector in its housing or recess in the box, a mechanical link between the box and the printed circuit board, and a coding function in order to provide a desired positioning of each contact to thereby prevent the misintroduction of a particular electric contact in a particular recess of the box.

BRIEF DESCRIPTION OF THE DRAWINGS

Other features and advantages of the invention will appear further from the description which will follow.

In the appended drawings, given as non-limiting examples.

DETAILED DESCRIPTION OF THE PREFERRED EMBODIMENT

FIGS. 1A, 1B, 2A and 2B show four embodiments of a plug of electrically insulating material, according to the present invention, of the type intended to be inserted in a box for the location of plural electric contacts, in a manner which will be described hereafter.

Figure 1A:
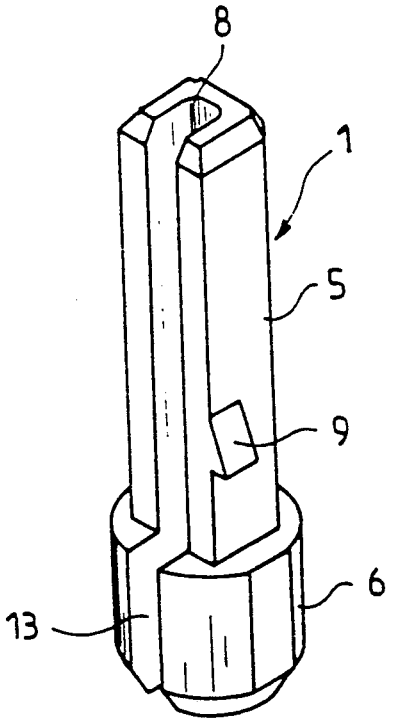
FIGS. 1A and 1B show, in perspective, two embodiments of an insulating plug according to the invention with a single first element.
Figure 1B:
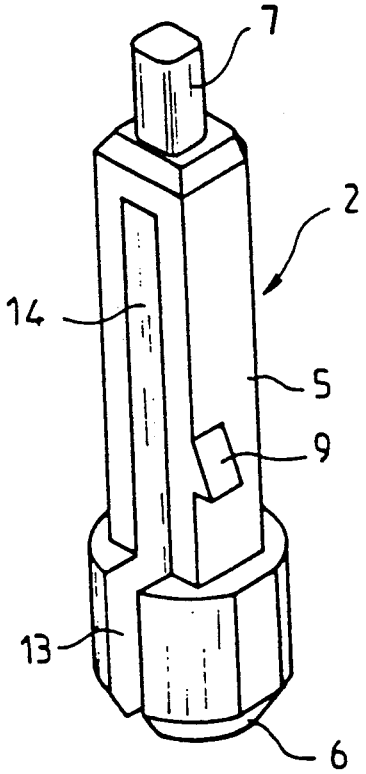
Figure 2A:
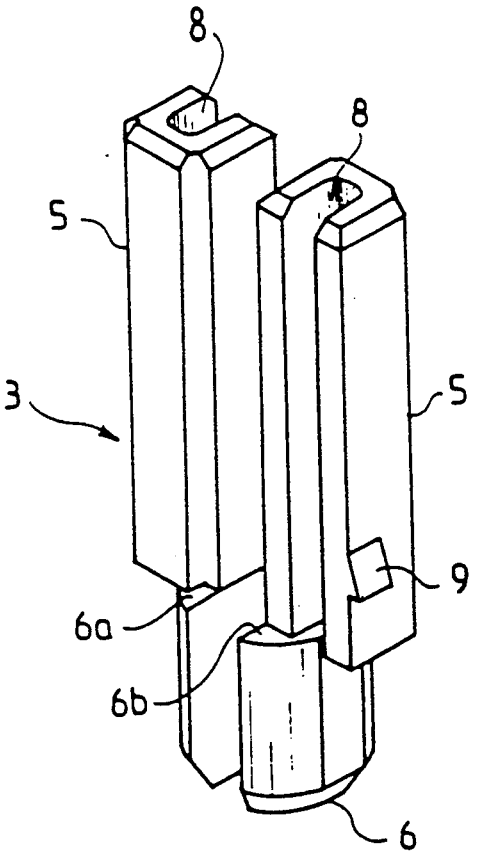
FIGS. 2A and 2B show, in perspective, two embodiments of an insulating plug according to the invention having two first elements.
Figure 2B:
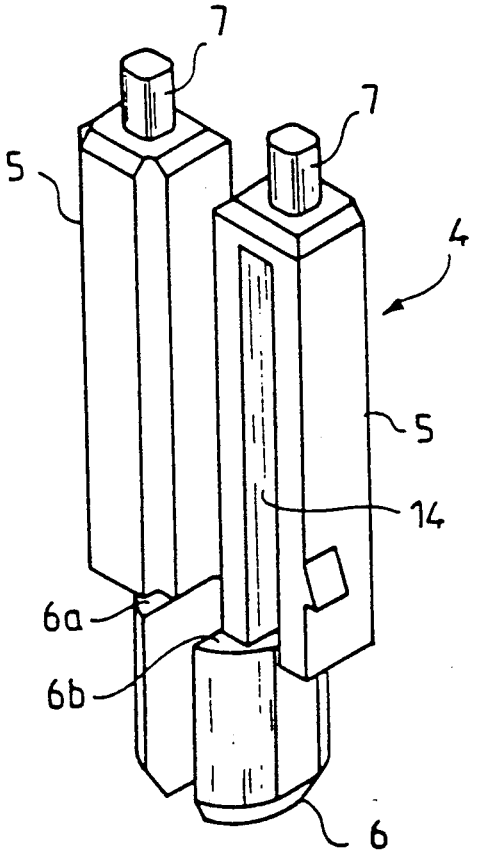

FIGS. 1A and 1B respectively represent insulating plugs 1 and 2 intended to be inserted in a housing box 10 (see FIG. 3) including a single row of connectors, whereas FIGS. 2A and 2B respectively represent insulating plugs 3 and 4 intended to be inserted in a box (not shown) with two contact rows.

As shown in FIGS. 1A, 1B, 2A and 2B, an insulating plug 1, 2, 3, 4 according to the invention includes at least a first element 5 constituting the essential part or the body of the plug and which is insertable in a bore 11 of box 10 for location of the contacts (FIG. 3) and a second element 6 defined to be inserted in a corresponding opening of a printed circuit board (not shown) to which the box 10 is connected in order to achieve electrical connection between the electric contacts supported in the box 10 and the printed circuits on the board.

Elements 5 and 6 of the plug are formed of an electrically insulating material, as a convenient plastic material, and, according to an advantageous feature of the invention, constitute a single part.

First element 5 has the general shape of an elongate bar having a transverse section which is substantially rectangular, in the shape of a hook or U which defines an axial bore 8 (in FIGS. 1A and 2A) and 14 (in FIGS. 1B and 2B).

In the case of FIGS. 1A and 2A, which more particularly represent insulating plugs 1 and 3 respectively, designed for the positioning of an electric contact inside a corresponding bore as 11 (FIG. 3) of box 10, axial bore 8 is opened on the opposite side of second element 6, externally to plugs 1, 3.

In case of the plug represented in FIGS. 1B and 2B, which is particularly intended to be used as locking element, i.e., for preventing the introduction of a particular contact in a determined recess 11 of box 10 (see more particularly FIG. 3), at the extremity of the insulating plug 2, 4, opposed to second element 6, the axial bore 14 is closed and extended by a member having the shape of a lug or stud 7, shaped for closing the corresponding bore 11 of the connector box 10 (see FIG. 3), so that the introduction of an electric contact of a connector in tne bore 11 is not permitted. In this case, the insulating plug 2 or 4 according to the invention provides a particular function of locking or coding.

FIGS. 2A and 2B illustrate an embodiment of the invention wherein the insulating plug 3 or 4 has two first elements 5 connected with a second single element 6, these two elements 5 being intended to be inserted in a box 10 (not shown) designed to receive two rows of electric contacts which are disposed in parallel one with each other.

As shown in the drawings, the second element 6, which has for an object to provide a mechanical link between the connector box 10, and a printed circuit board, has the shape of a horseshoe, the thickness of which, in the shown examples, is much smaller than the length of the elements 5, this horseshoe defining an axial bore 13 which:

- in case of FIGS. 1A and 1B, which show insulating plugs 1 and 2 intended for a connector box 10 with one row of electric contacts, extends in alignment with the axial bore 8 or 14 of the first element 5;
- in case of FIGS. 2A and 2B, which represent more particularly insulating plugs 3 and 4 intended for a connector box 10 with two parallel rows of electric contacts, has the shape of a horseshoe delimiting, on the side opposed to a printed circuit board, two rest surfaces 6*a* and 6*b* of the two first elements 5, the axial bores 8 and 14 respectively of which open partially on each side of the rest surfaces 6*a*, 6*b* and partially in correspondence with the rest surfaces 6*a*, 6*b*.

When the insulating plugs 1 and 3, according to the invention, are more particularly used for providing centering and/or positioning member for electrical contacts in a connector box 10, the above-described design of the insulating plug, i.e., more particularly the presence of bore 8 in the first element 5 and bore 13 in the second element 6 allows a mechanical link between the contacts of box 10 and the corresponding traces on the printed circuit board, in a very advantageous manner, by means of element 6 of the plug.

Figure 3:
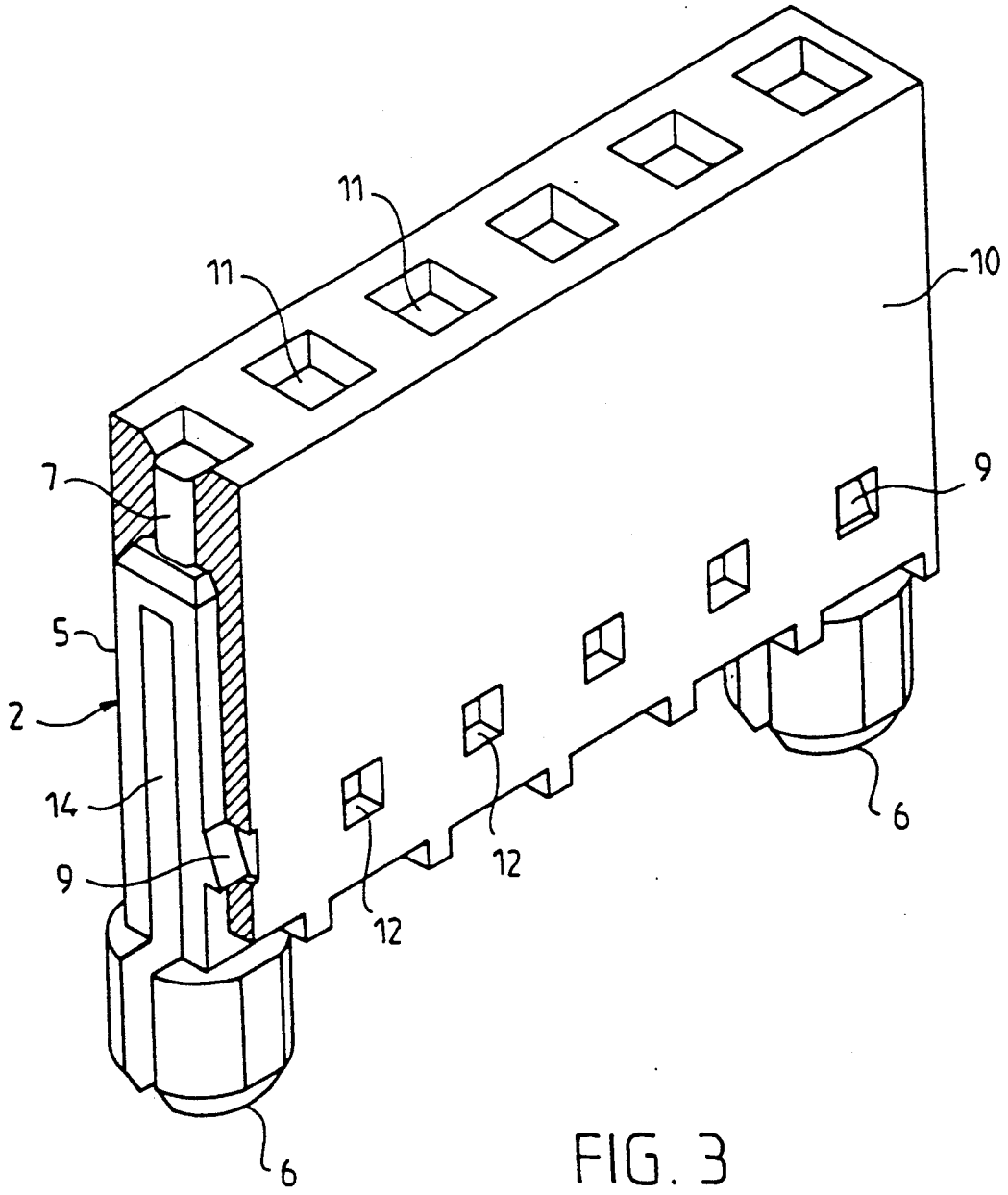
FIG. 3 represents two insulating plugs with a single first element located in a connector box with one row of connectors.

In FIG. 3 there is shown a connector box 10. In a bore 11 illustrated on the left portion of the connector box the insulating plug 2 shown on FIG. 1B is in locking position. More particularly, due to lug 7, plug 2 in box 10 prevents the introduction of an electric contact in its corresponding bore. It is also depicted in FIG. 3, that the first element 5 has, on one of its external surfaces, a locking member 9 (which can also be seen on FIGS. 1 through 4) having the shape of a protuberance adapted to connect, when inserting the plug, in a corresponding transverse bore 12 of box 10. In case of a plug having two elements 5, each element 5 may include a locking member, as member 9, or a single element 5 includes the locking member 9.

The invention provides therefore, in a particular and simple design, an insulating element capable of providing three essential functions, when a connector box with plural electrical contacts has to be electrically connected to a printed circuit board, i.e. a coding function, a positioning function of the electric contacts in their respective recesses of the box, as well as a mechanical link function between the connector box and the printed circuit board.

The invention is not limited to the preferred embodiments described and shown in the drawings, but is more particularly defined by the following claims, wherein the reference numerals have a clarification purpose and are not intended to limit the scope of the invention.

I claim:

1. An electric connector for electrical connection to a printed circuit board, comprising:

a housing box (10) having a plurality of bores (11) for selectively receiving and supporting therein electric contacts for electrical connection to conductive traces on said printed circuit boards; and a plug (1, 2, 3, 4) of insulating material having an elongate first element (5) received selectively in one of said bores (11) formed to receive one of said respective contacts, said first element terminating at one end thereof in a second element (6) comprising resilient means disposed exteriorly of said box (10) for insertion in an opening in said printed circuit board and at the other end thereof in means disposed in said bore (11) for selectively providing either receipt of a complementary electric contact or prevention of insertion of a complementary electric contact.

2. A connector according to claim 1, wherein the first and second elements (5, 6) of said plug (1, 2, 3 4) constitute a single part.

3. A connector according to claim 1, wherein at the extremity of the plug opposed to the second element (6), said means for selectively providing comprises an axial bore (8) opening at the end of said first element (5).

4. A connector according to claim 1, wherein at the extremity of the plug opposed to the second element (6), said means for selectively providing comprises a lug (7) shaped so as to close the corresponding bore (11) of the connector box (10).

5. A connector according to claim 1, wherein said first element (5), has, on one of its external surfaces, a locking member (9) shaped so as to be connected in a corresponding transverse bore (12) of said box (10).

6. A connector according to claim 1 wherein the first element (5) has a generally rectangular cross-section in the shape of a U which defines an axial bore (8, 14) of the plug (1, 2, 3, 4).

7. A connector according to claim 6, wherein said second element (6) is shaped as a horseshoe defining an axial bore which communicates with the axial bore (8, 14) of the first element (5).

8. A connector according to claim 1, wherein said plug comprises two said first elements (5) connected to a single second element (6) said two elements adapted to be inserted in a box for receiving two substantially parallel rows of electric contacts.

9. A connector according to claim 8, wherein said second element (6) is shaped as a horseshoe defining two rest areas (6*a*, 6*b*) for said two first elements (5).

10. An electric connector for electrical connection to a printed circuit board, comprising:

a housing box (10) having a plurality of bores (11) for selectively receiving and supporting therein electric contacts for electrical connection to conductive traces on said printed circuit board; and a plug (1, 2, 3, 4) of insulating material having an elongate first element (5) received selectively in one of said bores (11) formed to receive one of said respective contacts, said first element terminating at one end thereof in a second element (6) comprising resilient means disposed exteriorly of said box (10) for insertion in an opening in said printed circuit board and at the other end thereof in access means (8) disposed in said bore (11) for receipt of a complementary electric contact therein.

11. An electric connector for electrical connection to a printed circuit board, comprising:

a housing box (10) having a plurality of bores (11) for selectively receiving and supporting therein electric contacts for electrical connection to conductive traces on said printed circuit board; and a plug (1, 2, 3, 4) of insulating material having an elongate first element (5) received selectively in one of said bores (11) formed to receive one of said respective contacts, said first element terminating at one end thereof in a second element (6) comprising resilient means disposed exteriorly of said box (10) for insertion in an opening in said printed circuit board and at the other end thereof in closed means (7) disposed in said bore (11) for prevention of insertion of a complementary electric contact.

* * * * *